US005719360A

United States Patent [19]

Davis et al.

[11] Patent Number: 5,719,360

[45] Date of Patent: Feb. 17, 1998

[54] ADJUSTABLE TRANSFER FLOOR

[75] Inventors: Anne R. L. Davis, Middlefield; Jason S. Stone, Torrington, both of Conn.

[73] Assignee: Otis Elevator Company, Farmington, Conn.

[21] Appl. No.: 509,623

[22] Filed: Jul. 31, 1995

[51] Int. Cl.[6] ..... B66B 1/18; B66B 1/20

[52] U.S. Cl. ..... 187/383; 187/380

[58] Field of Search ..... 187/383, 380, 187/386, 387

[56] References Cited

U.S. PATENT DOCUMENTS

| | | | |
|---|---|---|---|
| 4,431,085 | 2/1984 | MacDonald | 187/383 |
| 4,846,311 | 7/1989 | Thangavelu | 187/125 |
| 5,168,133 | 12/1992 | Bajat et al. | 187/125 |
| 5,183,981 | 2/1993 | Thangavelu | 187/128 |
| 5,202,540 | 4/1993 | Aver et al. | 187/101 |

FOREIGN PATENT DOCUMENTS

| | | | |
|---|---|---|---|
| 3-238275 | 10/1991 | Japan | 187/383 |
| 4-80185 | 3/1992 | Japan | 187/388 |
| 5-162930 | 6/1993 | Japan | 187/383 |

*Primary Examiner*—Robert Nappi

[57] ABSTRACT

A multicar elevator system for servicing a plurality of floors in a building includes a plurality of elevator cars for servicing selected floors of the building; a controller for dispatching the plurality of elevator cars; input means for providing a transfer floor position signal to the controller; and an adjustable transfer floor for facilitating transfer of passengers between the plurality of elevator cars, wherein the controller adjusts the location of the adjustable transfer floor in response to the transfer floor position signal.

2 Claims, 4 Drawing Sheets

FIG.2

| | GROUP A | | | | GROUP B | | | |
|---|---|---|---|---|---|---|---|---|
| | 1 | 2 | 3 | 4 | 1 | 2 | 3 | 4 |
| 23 | | | | | X | X | X | X |
| 22 | | | | | X | X | X | X |
| 21 | | | | | X | X | X | X |
| 20 | AVAILABLE | | | | X | X | X | X |
| 19 | BUILDING | | | | X | X | X | X |
| 18 | SPACE | | | | X | X | X | X |
| 17 | | | | | X | X | X | X |
| 16 | | | | | X | X | X | X |
| 15 | | | | | X | X | X | X |
| 14 | | | | | X | X | X | X |
| 13 | D | D | D | D | X | X | X | X |
| 12 | D | D | D | D | X | X | X | X |
| 11 | T | T | T | T | T | T | T | T |
| 10 | X | X | X | X | D | D | D | D |
| 9 | X | X | X | X | D | D | D | D |
| 8 | X | X | X | X | EXPRESS ZONE | | | |
| 7 | X | X | X | X | | | | |
| 6 | X | X | X | X | | | | |
| 5 | X | X | X | X | | | | |
| 4 | X | X | X | X | | | | |
| 3 | X | X | X | X | | | | |
| 2 | X | X | X | X | | | | |
| UL | X | X | X | X | X | X | X | X |
| LL | X | X | X | X | X | X | X | X |

| | |
|---|---|
| | – FLOORS NOT SERVED |
| D | – FLOORS THAT ARE DISABLED |
| X | – FLOORS BEING SERVED |
| T | – TRANSFER FLOOR |

FIG.3

| | GROUP A | | | | GROUP B | | | |
|---|---|---|---|---|---|---|---|---|
| | 1 | 2 | 3 | 4 | 1 | 2 | 3 | 4 |
| 23 | | | | | X | X | X | X |
| 22 | | | | | X | X | X | X |
| 21 | | | | | X | X | X | X |
| 20 | AVAILABLE | | | | X | X | X | X |
| 19 | BUILDING | | | | X | X | X | X |
| 18 | SPACE | | | | X | X | X | X |
| 17 | | | | | X | X | X | X |
| 16 | | | | | X | X | X | X |
| 15 | | | | | X | X | X | X |
| 14 | | | | | X | X | X | X |
| 13 | D | D | D | D | X | X | X | X |
| 12 | D | D | D | D | X | X | X | X |
| 11 | D | D | D | D | X | X | X | X |
| 10 | D | D | D | D | X | X | X | X |
| 9 | T | T | T | T | T | T | T | T |
| 8 | X | X | X | X | EXPRESS ZONE | | | |
| 7 | X | X | X | X | | | | |
| 6 | X | X | X | X | | | | |
| 5 | X | X | X | X | | | | |
| 4 | X | X | X | X | | | | |
| 3 | X | X | X | X | | | | |
| 2 | X | X | X | X | | | | |
| UL | X | X | X | X | X | X | X | X |
| LL | X | X | X | X | X | X | X | X |

| | |
|---|---|
| | – FLOORS NOT SERVED |
| D | – FLOORS THAT ARE DISABLED |
| X | – FLOORS BEING SERVED |
| T | – TRANSFER FLOOR |

FIG. 4

| | GROUP A | | | | GROUP B | | | |
|---|---|---|---|---|---|---|---|---|
| | 1 | 2 | 3 | 4 | 1 | 2 | 3 | 4 |
| 23 | | | | | X | X | X | X |
| 22 | | | | | X | X | X | X |
| 21 | | | | | X | X | X | X |
| 20 | AVAILABLE | | | | X | X | X | X |
| 19 | BUILDING | | | | X | X | X | X |
| 18 | SPACE | | | | X | X | X | X |
| 17 | | | | | X | X | X | X |
| 16 | | | | | X | X | X | X |
| 15 | | | | | X | X | X | X |
| 14 | | | | | X | X | X | X |
| 13 | T | T | T | T | T | T | T | T |
| 12 | X | X | X | X | D | D | D | D |
| 11 | X | X | X | X | D | D | D | D |
| 10 | X | X | X | X | D | D | D | D |
| 9 | X | X | X | X | D | D | D | D |
| 8 | X | X | X | X | EXPRESS ZONE | | | |
| 7 | X | X | X | X | | | | |
| 6 | X | X | X | X | | | | |
| 5 | X | X | X | X | | | | |
| 4 | X | X | X | X | | | | |
| 3 | X | X | X | X | | | | |
| 2 | X | X | X | X | | | | |
| UL | X | X | X | X | X | X | X | X |
| LL | X | X | X | X | X | X | X | X |

| | |
|---|---|
| | – FLOORS NOT SERVED |
| D | – FLOORS THAT ARE DISABLED |
| X | – FLOORS BEING SERVED |
| T | – TRANSFER FLOOR |

ADJUSTABLE TRANSFER FLOOR

TECHNICAL FIELD

The present invention relates generally to elevator systems and, in particular, relates to a transfer floor in an elevator system.

BACKGROUND

To facilitate efficient elevator dispatching in an elevator system, elevator cars in high rise buildings are typically allocated in elevator groups. Each elevator group services a predetermined set of floors. The hoistway space in some of the remaining floors that are not served by the elevator group may be designated as either an express zone or available building space. An electroluminescent display is disposed in the hallway for displaying the predetermined set of floors that each group services.

If a building has two elevator groups then the floors can be partitioned into an upper group of floors and a lower group of floors. For example, a first elevator group can be used to service the lower group of floors and the second elevator group can be used to service the upper group of floors. The lower group of floors may be designated by the second elevator group as an express zone. Accordingly, if a passenger in a lobby wishes to expeditiously travel to a top floor, the passenger can choose an elevator in the second elevator group.

When activated, a transfer floor is fixedly located between the upper and lower groups of floors. The transfer floor allows passengers to transfer from an elevator car in one elevator group to an elevator car in another elevator group. For example, if the passenger who wishes to travel to the top floor is located at a floor that is in the express zone of the second group, he must first travel to the transfer floor via an elevator car in the first group and then move to an elevator car in the second group.

The transfer floor is fixed at a central location in the building such that under normal conditions the travel time of the passengers is reduced and an increase in elevator system efficiency and performance is provided. However, if an elevator car in a group is out of service or travel conditions deviate from normal then a reduction in elevator system efficiency and performance may occur.

DISCLOSURE OF THE INVENTION

It is an object of the present invention to provide increased efficiency and performance of an elevator system having a transfer floor.

It is another object of the present invention to minimize the waiting time for passengers being served by a group of elevator cars that has either heavy traffic or an elevator car out of service.

According to the present invention, a multicar elevator system for servicing a plurality of floors in a building includes a plurality of elevator cars for servicing selected floors of the building; a first car serves a low rise range of floors and a second car serves a high rise range of floors; each of a plurality of transfer floors may be selected by the controller to facilitate transfer of passengers between the first and second elevator cars; the controller restricts call registration such that up calls to the selected transfer floor cannot be made from the high rise elevator car, and down calls cannot be accepted at the transfer floor by the high rise elevator car.

In further accord with present invention, a method of assigning floors among a plurality of elevators includes the steps of providing a transfer floor location selection signal to a controller; assigning a transfer floor in response to the transfer floor location selection signal; and adjusting a range of floors that each elevator group can service in each direction in response to the change in location of the transfer floor.

The present invention provides the advantages of increased efficiency and performance of an elevator system by providing an adjustable transfer floor. The adjustable transfer floor allows the elevator system to adapt to various detrimental conditions such as a failed elevator car without a significant loss in performance. For example, if a elevator car in an elevator group fails, the present invention reduces the number of floors that the elevator group must service by changing the location of the transfer floor.

These and other features, aspects and advantages of the present invention will become better understood with regard to the following description, appended claims and accompanying drawings.

BRIEF DESCRIPTION OF THE DRAWINGS

FIGS. 2, 3 and 4 are schematic block diagrams of two elevator groups disposed in a building with an adjustable transfer floor of the present invention.

BEST MODE FOR CARRYING OUT THE INVENTION

Figure 1:
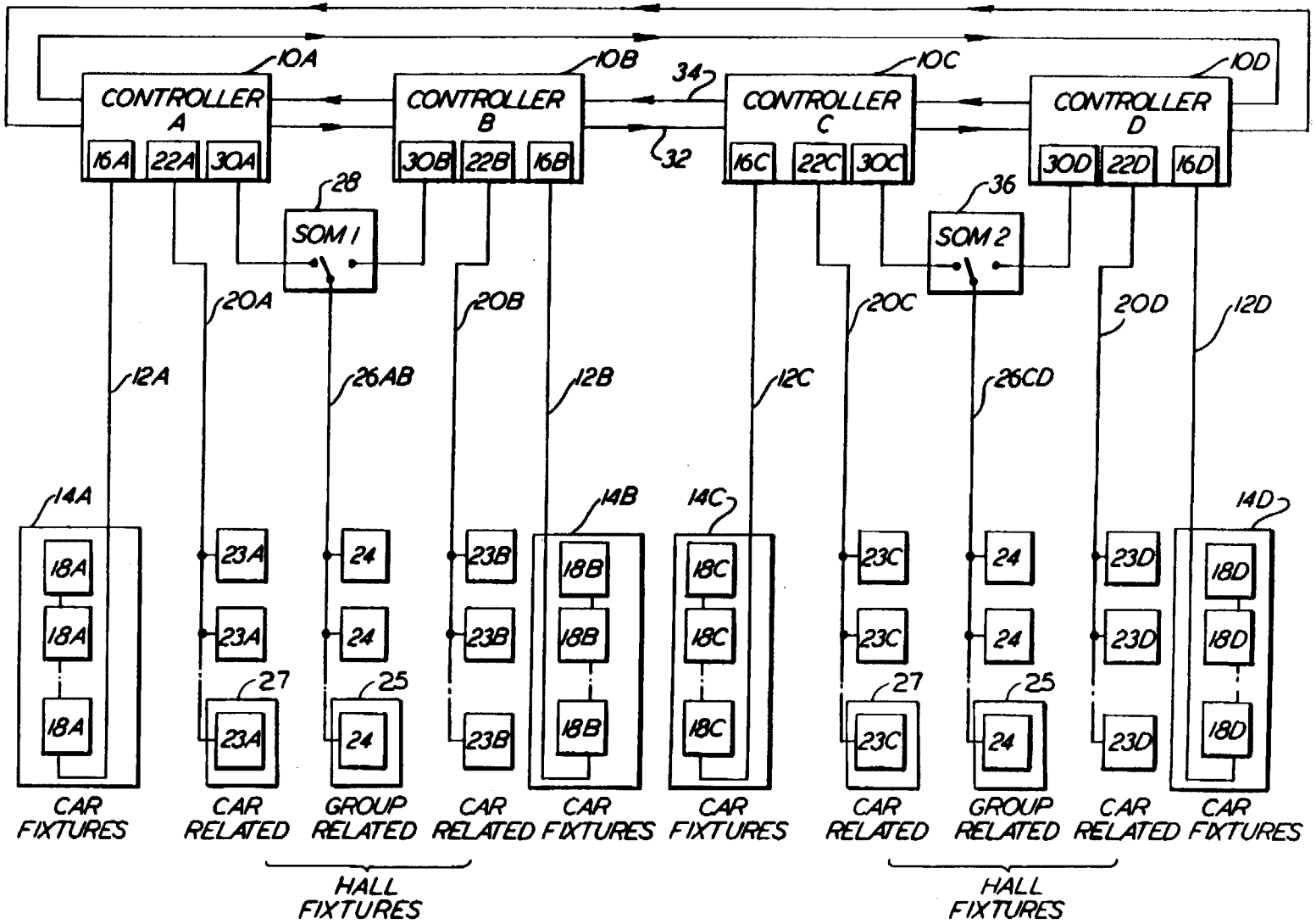
FIG. 1 is a schematic block diagram of an elevator group.

FIG. 1 shows a system architecture of the two-way ring communication system for a four-car group embodying the principles of the present invention. A car controller 10A is connected via a serial link 12A to fixtures in the car 14A. A master station 16A in the car controller 10A, and remote stations 18A in the car 14A serve as interfaces to the serial link 12A, and are discussed in detail in commonly-owned U.S. Pat. No. 4,497,391 (Mendelsohn et al, 1985), entitled MODULAR OPERATIONAL ELEVATOR CONTROL SYSTEM. The car controller 10A is also connected via a serial link 20A to car-related hall fixtures; again via a master station 22A in the car controller 10A and remote stations 23A associated with the car-related hall fixtures.

Car controllers 10B, 10C and 10D are identical to the car controller 10A, and are similarly connected via master stations 16B–16D, serial links 12B–12D, and remote stations 23B–23D to car fixtures for the cars 14B–14D; and via master stations 22B–22D, serial links 20B–20D, and remote stations 18B–18D to car-related hall fixtures for the car 14B–14D. Group-related hall fixtures are linked via remote stations 24 and a serial link 26AB to a switchover module 28 that is operable to provide the signals to/from master station 30A or 30B in either of the controllers 10A or 10B, respectively.

The switchover module 28 is used to ensure the operation of the group related hall fixtures if the car controller 10A fails or is switched off. The purpose of the switchover module 28 is to connect group related hall fixtures to one of two car controllers. In the event one car controller fails or is switched off, the switchover module connects the group related hall fixtures to the other car controller. Accordingly, the switchover module 28 provides signals to/from the master station 30A in the controller 10A or to/from the master station 30B in the controller 10B.

A second switchover module 36 receives signals on serial link 26CD from remote stations 24 associated with a second, optional set of group-related hall fixtures, and is operable to provide these signals to/from master stations 30C or 30D in either of the controllers 10C or 10D, respectively. As shown in FIG. 1, the switchover module 36 is providing signals to/from the master station 30C in the controller 10C.

One group related hall fixture, according to the present invention, is an adjustable transfer floor switch ("ATF switch") 25 that is connected to serial link 26AB via remote stations 24. In a preferred embodiment, the ATF switch 25 is a key switch. The ATF switch 25 is used to activate the adjustable transfer floor features embodied in the present invention as is explained hereinbelow. Of course, one skilled in the art understands that other types of switches either in hardware or software could be utilized in the present invention.

The car controllers 10A–10D are connected for communication with one another via a two-way communication ring comprising a first serial link 32 providing data one way from the controller 10A, to the controller 10B, to the controller 10C, to the controller 10D, and a second serial link 34 providing data in the opposite direction from the controller 10D, to the controller 10C, to the controller 10B, to the controller 10A. Thus, each car controller is in direct communication with the next and previous car controller on the ring. Messages are passed around the ring under control of each car controller, which performs an error check and passes the received message to the next car controller only if no errors are detected. This communication concept provides, in the case of a car controller failure, the ability to isolate a faulty car controller by the two neighboring car controllers. In this event, further communication is ensured as a result of the two ring communication lines.

In one preferred embodiment, messages are processed on the ring communication system in a manner as described in detail in commonly-owned U.S. Pat. No. 5,202,540, (Auer et al., 1993) entitled TWO-WAY RING COMMUNICATION SYSTEM FOR ELEVATOR GROUP CONTROL.

Of course, it should be realized that the present invention can be used in conjunction with other elevator communication systems including central controller configurations, among others.

The present invention allows the position of the transfer floor to be adjusted to alternative floor locations to compensate for various detrimental system conditions such as a failure of one of the elevators in a particular elevator group. Accordingly, the ATF switch 25 is used to select the floor location of the transfer floor. In a preferred embodiment, the ATF switch 25 is a key switch that provides a transfer floor position signal having a value that is dependent on the setting or position of the key switch and which represents a particular transfer floor position. For example, the ATF switch 25 may have three unique settings or positions, such as a NORMAL, an ATFPOS1 and an ATFPOS2 position, wherein each switch position corresponds to a unique transfer floor location signal selection that represents a unique transfer floor position as is described in the exemplary embodiment below.

The ATF switch 25 transmits the transfer floor location selection signal to one of the controllers 10A or 10B in the elevator system. Accordingly, the ATF switch 25 is linked via remote stations 24 and a serial link 26AB to a switchover module 28 that is operable to provide signals to/from master station 30A or 30B in either of the controllers 10A or 10B, respectively. Alternatively, the ATF switch 25 can be linked via remote stations 24 and a serial link 26CD to a switchover module 36 that is operable to provide signals to/from master station 30C or 30D in either of the controllers 10C or 10D, respectively.

It should be understood by one skilled in the art that the ATF switch can be implemented in software as well as hardware. For example, the values of the transfer floor signal can be embedded in a memory and processed automatically in accordance with the present invention by a microprocessor.

The controller adjusts the location of the transfer floor in response to the value of the transfer floor location selection signal. The location of the transfer floor is adjustable within a range of the plurality of floors in the building. For example, if the ATF switch 25 is in the NORMAL position then the controller adjusts the transfer floor to a predetermined location where the travel time of the passengers is reduced and an increase in elevator system efficiency and performance is provided under normal conditions. The controller adjusts the location of the transfer floor by changing transfer floor setup parameters in memory. An exemplary embodiment of the present invention is described below.

Referring to FIGS. 2, 3, 4, a building includes a lower lobby LL, an upper lobby UL and a plurality of floors 2–23. An elevator system, in this exemplary embodiment, includes elevator groups A and B such that each elevator group includes four elevator cars. Each elevator group serves a plurality of floors X. A transfer floor T is used to facilitate passenger transfer from one elevator group to another. In accordance with one embodiment of the present invention, the adjustable transfer floor T is adjustable between floors 9 through 13.

FIG. 2 shows a building service configuration corresponding to a NORMAL ATF switch setting. The NORMAL setting provides that the transfer floor T is located at floor 11. Elevator group A serves the upper lobby, the lower lobby and floors 2 through 11. Elevator group B serves the upper lobby, the lower lobby and floors 12 through 23. This service configuration may be chosen under normal traffic conditions and when all elevator cars of groups A and B are functional.

FIG. 3 shows a building service configuration corresponding to an ATFPOS1 ATF switch setting. The ATFPOS1 setting allows the elevator group A to serve the upper lobby, the lower lobby and floors 2 through 9. Elevator group B serves the upper lobby, the lower lobby and floors 10 through 23. This configuration decreases the burden on the elevator system in servicing the floors in the building with elevator group A by reducing the number of floors that group A must service. Thus, this service configuration may be chosen if elevator group A is experiencing heavy traffic or one or more non-functional elevator cars.

FIG. 4 shows a building service configuration corresponding to an ATFPOS2 ATF switch setting. The ATFPOS2 setting allows the elevator group A to serve the upper lobby, the lower lobby and floors 2 through 13. Elevator group B serves the upper lobby, the lower lobby, and floors 14 through 23. This configuration provides fewer floors for group B to service which in turn decreases the burden on the elevator system in servicing the building with elevator group A. Thus, this service configuration may be chosen if elevator group B is experiencing one or more non-functional elevator cars or heavy traffic.

When the transfer floor location changes, all transfer operations are disabled for the previous transfer floor location and are applied to the new transfer floor location. This is accomplished by changing transfer floor parameters in memory. In one embodiment, the memory is located in the controller. The transfer floor operations include restrictions on car calls and hall calls made in a high rise group; e.g., group B. For example, up car calls to the transfer floor in an elevator located below the transfer floor in group B are disabled and down hall calls at the transfer floor are disabled for elevator cars in group B. These restrictions prevent the use of the express zone for purposes other than providing efficient service to the upper floors.

Additionally, when the transfer floor location changes the range of landings that each group can serve is also changed or adjusted. All landings that can be physically reached by the elevator cars in the group but are not within the new range of landings are disabled with respect to that elevator group. All landings that can be physically reached by the elevator cars in the group but are within the new range of landings are enabled with respect to that elevator group.

An electroluminescent display 27 (shown in FIG. 1) is disposed in the hallway for displaying the set of floors that each elevator group services. When the range of landings that each elevator group can serve is changed or adjusted a message displayed by the electroluminescent display 27 is changed to reflect the new range of service provided by the elevator group. The change in the display 27 is in response to the change in the transfer floor position signal. In a preferred embodiment, the display 27 indicates that the range of floors for group A is the first floor above the lobby to the transfer floor and the range of floors for group B is the first floor above the transfer floor to the top floor. For example, if the ATF switch is set on the ATFPOS1 position then the display 27 at the lobby indicates that the range of floors served for group A is floors 2 through 9 and the range of floors for group B is floors 10 through 23.

Thus, the present invention provides the advantages of robustness and adaptability in an elevator system by allowing the elevator system to alter the location of a transfer floor. Moreover, the adjustable transfer floor allows the elevator system to adapt to various detrimental conditions such as a failed elevator car without a significant loss in performance.

Various changes to the above description may be made without departing from the spirit and scope of the present invention as would be obvious to one of ordinary skill in the art of the present invention.

What is claimed is:

1. A multicar elevator system for servicing a plurality of floors in a building, said multicar elevator system comprising:

a plurality of elevator cars for servicing selected floors of the building, including a first elevator car for servicing a low rise range of floors and a second elevator car for servicing a high rise range of floors;

a controller for dispatching said plurality of elevator cars;

a plurality of selectable transfer floors, each for facilitating, when selected, transfer of passengers between said plurality of elevator cars;

input means for providing a transfer floor location selection signal to said controller, wherein said controller adjusts the range of floors that each of said cars can serve in response to the transfer floor location selection signal, said controller providing restrictions on call registration such that an up call to said transfer floor is disabled for the second elevator car.

2. The multicar elevator system for servicing a plurality of floors in a building as recited in claim 1 wherein said plurality of elevator cars comprise a first elevator car for servicing a low rise range of floors and a second elevator car for servicing a high rise range of floors, said controller providing restrictions on call registration such that a down call at said transfer floor is disabled for the second elevator car.

* * * * *